United States Patent [19]

Malone

[11] Patent Number: 4,770,114

[45] Date of Patent: Sep. 13, 1988

[54] T.V. REMOTE CONTROL BOX FINDER

[76] Inventor: James P. Malone, 1 Hillside Ave., P.O. Box 678, Rockville Centre, N.Y. 11570

[21] Appl. No.: 47,265

[22] Filed: May 8, 1987

[51] Int. Cl.[4] ..... G08B 7/00; G10K 1/00

[52] U.S. Cl. ..... 116/200; 116/148; 116/DIG. 30

[58] Field of Search ..... 116/148, 170, 234, 209, 116/236–239, 85, 86, 97, 6, 10, 169, 200, 1, DIG. 1, 173, 28 R, DIG. 30; 119/106; 84/406; 211/26; 248/317; 2/338

[56] References Cited

U.S. PATENT DOCUMENTS

| | | | |
|---|---|---|---|
| 122,020 | 12/1871 | Hughs et al. | 119/106 |
| 215,559 | 5/1879 | Bevin | 116/170 |
| 883,611 | 3/1908 | Barad et al. | 119/106 |
| 1,623,002 | 3/1927 | Gossett | 119/106 |
| 2,601,839 | 7/1952 | Kucewicz | 116/148 |
| 2,920,604 | 1/1960 | McDonald, Jr. | 116/169 |
| 3,685,482 | 8/1972 | Ryder | 116/209 |
| 3,848,271 | 11/1974 | Goele | 2/338 |
| 3,898,951 | 8/1975 | Clare | 116/239 |
| 4,101,873 | 7/1978 | Anderson et al. | 340/539 |
| 4,134,154 | 1/1979 | Faulkner | 2/338 |
| 4,157,166 | 6/1979 | Voelker | 243/317 |
| 4,507,653 | 3/1985 | Bayer | 340/539 |

FOREIGN PATENT DOCUMENTS

| | | | |
|---|---|---|---|
| 583483 | 1/1925 | France | 150/102 |
| 42648 | 1/1917 | Sweden | 116/170 |

OTHER PUBLICATIONS

"Musical Sleigh Bells", Wexler Catalog, 1965, p. 504.

*Primary Examiner*—William A. Cuchlinski, Jr.
*Assistant Examiner*—W. Morris Worth
*Attorney, Agent, or Firm*—James P. Malone

[57] ABSTRACT

A finder for a T.V. remote control box has an elongated flexible tail connected to the remote control box. The tail preferably has a color contrasting with the color of newspapers and has at least one bell attached to it, and at least one aperture for hanging up the control box.

1 Claim, 1 Drawing Sheet

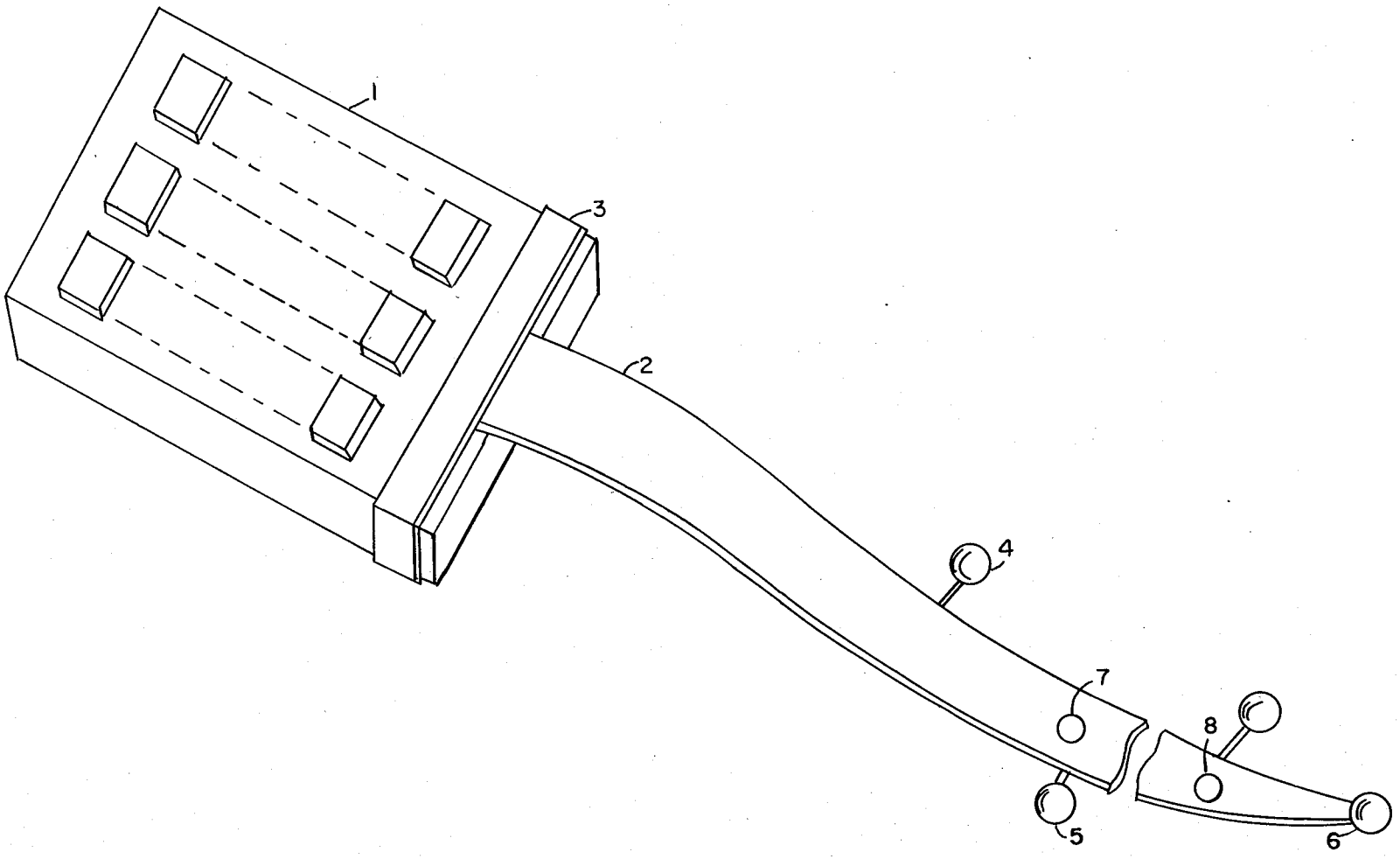
1
2
3
4
5
6
7
8

T.V. REMOTE CONTROL BOX FINDER

TECHNICAL FIELD

This invention relates to remote T.V. control boxes and more particularly to an appendage or tail attached to the control box for the purpose of finding the control box.

BACKGROUND

T.V. remote control boxes are quite common to control the T.V. apparatus from a distance, for instance, across a room.

A difficulty with these control boxes is that they are adapted to be held in one hand and are quite small, about 3×5 inches. The box tends to get misplaced and lost quite often under newspapers, cushions and furniture, which requires frequent searching for the control box.

THE INVENTION

Finder means for T.V. remote control box comprises an elongated flexible tail and means to connect the tail to the remote control box. The tail preferably has a color contrasting with the color of newspapers. The tail has at least one bell attached to it and at least one aperture for hanging up the control box.

OBJECTS OF THE INVENTION

A principal object of the invention is to provide new and improved means for finding T.V. remote control boxes.

Another object of the invention is to provide new and improved means for finding T.V. remote control boxes comprising a flexible tail or appendage attached to the box.

Another object of the invention is to provide new and improved means for finding T.V. remote control boxes comprising a flexible tail or appendage attached to the box, the appendage having at least one bell and at least one aperture for hanging up the control box.

Another object of the invention is to provide new and improved finder means for T.V. remote control box comprising: an elongated flexible tail and means to connect the tail to the remote control box.

FIGURES

The FIGURE shows a perspective view of an embodiment of the invention.

BEST MODE OF THE INVENTION

Referring to the FIGURE, the conventional control box 1 is adapted to be held in one hand and is approximately 3×5 inches and it contains a number of pushbuttons for controlling the T.V. set. Attached to the T.V. box is a flexible tail or appendage 2, which preferably is two to three feet long. The tail 2 is connected to the control box by means of an elastic band 3. The tail may also be attached by adhesive or other conventional connecting means. The tail preferably has a plurality of small bells, 4,5, 6. These may be of the type about one-half inch in diameter having loose elements inside for creating sound. The bells are useful when the T.V. box is covered up by a stack of newspapers so that by shaking the stack, you will hear the bell sound.

The tail preferably has at least one aperture 7 for hanging up the assembly. Another aperture 8 may be added if so desired.

The tail may be made of flexible leather, cloth, cloth tape or other equivalents, and preferably, has a bright color or one that contrasts with newspapers, couch cushions, etc. The tail may also be formed of connected segments.

The elastic band is preferably used since the elastic band allows the tail to be easily removed if desired.

It is claimed:

1. Finder means for a T.V. remote control box comprising: an elongated tail and means for connecting the tail to the remote control box wherein the tail is brightly colored and generally contrasting with the color of newspapers, the tail having at least one bell attached thereto, the tail having at least one aperature therein for hanging up the tail, and the means for connecting comprising an elastic band adapted to surround the T.V. remote control box, whereby a misplaced and covered control box may be found by visually locating the tail and audibly by actuating the bell when moving and shaking materials which are hiding the control box.

* * * * *